US007005058B1

(12) United States Patent
Towler

(10) Patent No.: US 7,005,058 B1
(45) Date of Patent: Feb. 28, 2006

(54) PROCESS AND APPARATUS FOR REMOVING SULFUR FROM HYDROCARBONS

(75) Inventor: Gavin P. Towler, Barrington, IL (US)

(73) Assignee: UOP LLC, Des Plaines, IL (US)

( * ) Notice: Subject to any disclaimer, the term of this patent is extended or adjusted under 35 U.S.C. 154(b) by 814 days.

(21) Appl. No.: 10/141,449

(22) Filed: May 8, 2002

(51) Int. Cl.
*C10G 45/00* (2006.01)

(52) U.S. Cl. ..... 208/211; 208/212

(58) Field of Classification Search ..... 208/211, 208/212
See application file for complete search history.

(56) References Cited

U.S. PATENT DOCUMENTS

| | | | | |
|---|---|---|---|---|
| 2,471,134 | A | 5/1949 | Wright | 196/100 |
| 2,634,230 | A | 4/1953 | Arnold et al. | 196/24 |
| 2,792,332 | A | 5/1957 | Hutchings | 196/14.17 |
| 2,853,432 | A | 9/1958 | Gleim et al. | 196/32 |
| 2,988,500 | A | 6/1961 | Gleim et al. | 208/206 |
| 3,108,081 | A | 10/1963 | Gleim et al. | 252/428 |
| 3,647,680 | A | 3/1972 | Greenwood et al. | 208/65 |
| 3,652,231 | A | 3/1972 | Greenwood et al. | 23/288 G |
| 3,692,496 | A | 9/1972 | Greenwood et al. | 23/288 G |
| 3,923,645 | A | 12/1975 | Anderson, Jr. et al. | 208/206 |
| 3,957,625 | A | 5/1976 | Orkin | 208/211 |
| 3,980,582 | A | 9/1976 | Anderson, Jr. et al. | 252/428 |
| 4,049,572 | A | 9/1977 | Douglas | 252/431 N |
| 4,090,954 | A | 5/1978 | Ward | 208/206 |
| 4,230,533 | A | 10/1980 | Giroux | 203/1 |
| 4,337,156 | A | 6/1982 | deRosset | 210/672 |
| 4,498,980 | A | 2/1985 | Forte | 208/321 |
| 4,775,462 | A | 10/1988 | Imai et al. | 208/189 |
| 4,781,820 | A | 11/1988 | Forte | 208/333 |
| 4,832,921 | A | 5/1989 | Greenwood | 422/223 |
| 4,956,324 | A | 9/1990 | Pollastrini et al. | 502/163 |
| 5,244,643 | A | 9/1993 | Verachtert | 423/243.08 |
| 5,582,714 | A | 12/1996 | Forte | 208/237 |

(Continued)

FOREIGN PATENT DOCUMENTS

CA 2087926 1/1993

OTHER PUBLICATIONS

Paper AM-00-54, "Removal of Sulfur from Light FCC Gasoline Stream" by R.E. Maple and H.W. Wizig, presented at the NPRA Annual Meeting, Mar. 26-28, 2000, San Antonio, Texas.

(Continued)

*Primary Examiner*—Walter D. Griffin
*Assistant Examiner*—In Suk Bullock
(74) *Attorney, Agent, or Firm*—John G. Tolomei; James C. Paschall

(57) ABSTRACT

Disclosed is an apparatus and process for controlling the sulfur content of effluent from a hydrocarbon fractionation column. The effluent includes a low boiling stream, a middle boiling stream and a high boiling stream. Either of the feed or the low boiling stream may be subjected to a mercaptan removal treatment such as thioetherification or mercaptan oxidation treatment. The high boiling stream is subjected to hydrotreatment which will rid the high boiling stream of almost all organic sulfur compounds. The middle boiling stream may be subjected to a sulfur treatment complex which may comprise a sulfur removal unit and/or a catalytic reforming unit which may already be present in the refinery. Control valves govern the flow of adding the middle boiling stream to the low boiling stream and the high boiling stream in response to the sulfur concentration of the overhead stream downstream of the mercaptan removal treatment.

8 Claims, 1 Drawing Sheet

U.S. PATENT DOCUMENTS

| | | | | |
|---|---|---|---|---|
| 5,817,595 | A | 10/1998 | Tejada et al. | 502/313 |
| 5,928,497 | A | 7/1999 | Iaccino | 208/212 |
| 6,013,173 | A | 1/2000 | Bogdan | 208/139 |
| 6,156,084 | A | 12/2000 | Bonville, Jr. et al. | 48/61 |
| 6,228,254 | B1 | 5/2001 | Jossens et al. | 208/212 |
| 6,444,118 | B1 | 9/2002 | Podrebarac et al. | 208/210 |

OTHER PUBLICATIONS

*Handbook of Petroleum Refining Processes*, (Robert A. Meyers, Second Edition, 1997), 11.30-11.31.

Paper AM-00-35, "Novel Process for FCC Gasoline Desulfurization and Benzene Reduction to Meet Clean Fuels Requirements" by J.C. Gentry and F. Lee, presented at the NPRA Annual Meeting, Mar. 26-28, 2000, San Antonio, Texas.

*Handbook of Petroleum Refining Processes*, (Robert A. Meyers, Second Edition, 1997), 4.3-4.26.

Article "Azeotrope Formation between Sulfur Compounds and Hydrocarbons" by D.H. Desty and F.A. Fidler, *Industrial and Engineering Chemistry*, vol. 43, No. 4, Apr. 1951, pp. 905-910.

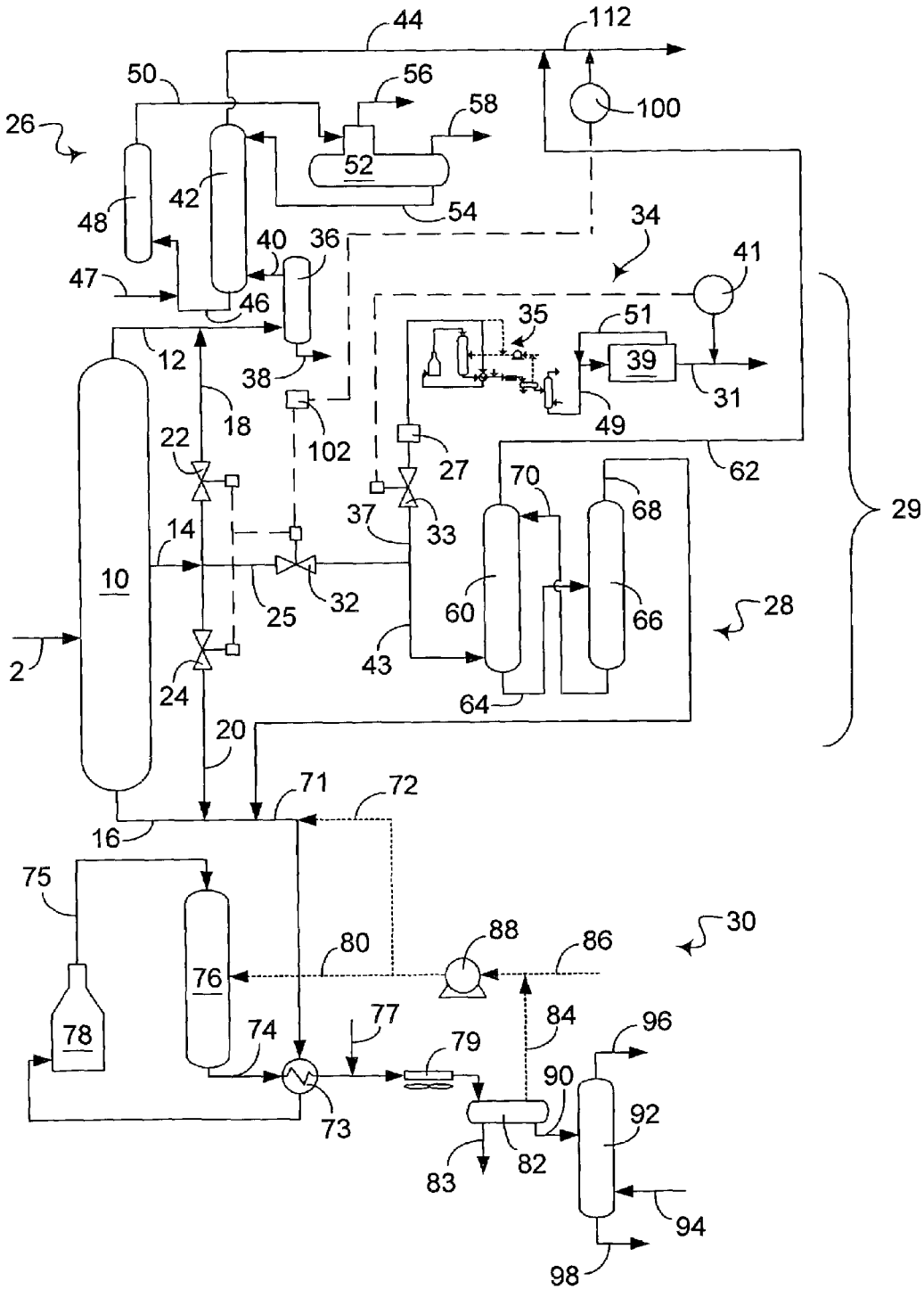
44
112
50
56
58
100
26
52
42
48
54
34
40
36
41
47
46
35
51
12
39
38
31
18
102
49
22
27
62
70
68
29
37
33
14
10
32
25
60
66
28
2
43
24
64
20
71
72
16
75
30
88
86
80
76
78
74
77
84
96
79
90
73
92
83
82
94
98

PROCESS AND APPARATUS FOR REMOVING SULFUR FROM HYDROCARBONS

FIELD OF THE INVENTION

The present invention is directed to a process and apparatus for reducing concentrations of sulfur in hydrocarbon streams to a very low level. Specifically, the present invention is directed to a process and apparatus for reducing sulfur in gasoline using a three-way distillation column.

BACKGROUND OF THE INVENTION

Gasoline is generally prepared from a number of hydrocarbonaceous blend streams such as butanes, light straight run naphtha, isomerate, fluidized catalytically cracked gasoline, hydrocracked naphtha, coker gasoline, alkylate, reformate, ethers and alcohols. Of these, gasoline blend stocks produced in fluidized catalytic cracking (FCC) units, reformer units and alkylation units account for a major portion of the world's gasoline pool. FCC gasoline, and if present, coker gasoline and pyrolysis gasoline, generally contribute to a substantial portion of the concentration of organic sulfur in the gasoline pool.

Organic sulfur present in the gasoline pool may be in one of several molecular forms, including thiophenes, benzothiophenes, mercaptans, sulfides and disulfides. Typical thiophenes and benzothiophenes include their alkylated derivatives. Of particular interest are 2-methylthiophene, 3-methylthiophene, 2-ethylthiophene and dimethylbenzothiophene. Typical mercaptans occurring in the sulfur-containing gasoline streams include thiophenol and alkylthiols from ethanethiol to decanethiol with potentially smaller amounts of the higher alkylthiols. Mercaptans of particular interest include 1-ethanethiol, 2-propanethiol, 2-butanethiol, 2-methyl-2-propanethiol, pentanethiol, hexanethiol, heptanethiol, octanethiol, nonanethiol and thiophenol. Sulfides and disulfides in the gasoline pool may be the result of thioetherification, mercaptan oxidation or extraction treatments upstream.

Many gasoline blend streams also contain olefins which tend to have a higher octane value than their paraffinic counterpart. Blend streams originating from an FCC unit, for example, will be olefinic, with an olefin content of at least 5 or more percent, and typically in the range of 10 to 30 percent.

A number of methods have been proposed for removing sulfur from gasoline. In general, hydrotreating is very popular because of the cost and ease of processing using a catalytic hydrotreating method. However, sulfur removed by hydrotreating is generally accompanied by a substantial reduction in octane number because the olefins are saturated to paraffins.

In order to meet new stricter gasoline sulfur specifications while minimizing octane loss, most refiners will end up fractionating the FCC gasoline into at least two streams. The overhead stream will be rich in olefins and contain a low fraction of the total sulfur from the feed. Most of the sulfur present in the overhead stream will be in the form of mercaptans, disulfides and dissolved hydrogen sulfide.

U.S. application Ser. No. 09/901,215 filed by the assignee of the present invention, and incorporated herein by reference, discloses a process for desulfurizing a gasoline stream containing sulfur compounds and olefins by fractionating it into three fractions. The low-boiling fraction is subjected to mercaptan oxidation to remove at least a portion of the mercaptan sulfur compounds. The mid-boiling fraction containing thiophene and olefins is subjected to solvent extraction to produce a product raffinate stream containing olefins and having a reduced sulfur content and a rich solvent stream enriched in thiophene. The rich solvent stream enriched in thiophene is separated to produce a hydrocarbonaceous stream rich in thiophene. The resulting hydrocarbonaceous stream rich in thiophene and the higher boiling fraction containing sulfur compounds are reacted in a hydrodesulfurization reaction zone to produce a hydrocarbon stream with a reduced sulfur content.

The paper titled, "Removal of Sulfur from Light FCC Gasoline Streams," presented at the NPRA 2000 Annual Meeting on Mar. 26–28, 2000 in San Antonio, Tex., discloses that sulfur compounds in the initial boiling range of light FCC gasoline are primarily mercaptans which are extractable in a mercaptan oxidation process.

An extraction mercaptan oxidation process is described in D. L. Holbrook *Handbook of Petroleum Refining Processes*, 11.30–11.31 (Robert A. Meyers, 2d ed., 1997). In this process, a liquid hydrocarbon stream is pretreated to remove or dissolve hydrogen sulfide in caustic. The pretreated hydrocarbon stream is subjected to counter-current flow with caustic in an extractor vessel. Mercaptans in the hydrocarbon stream react with caustic to yield mercaptides which are soluble in the caustic. A product hydrocarbon stream lean in mercaptans passes overhead and a mercaptide-rich caustic passes from the bottoms. The mercaptide-rich caustic is mixed with air and catalyst to oxidize the mercaptides to disulfides. The caustic is separated from the disulfides and is returned to the extraction.

U.S. Pat. No. 5,244,643 B1 discloses a non-extractive mercaptan oxidation process whereby a hydrocarbonaceous gas stream including mercaptan sulfur, air and aqueous alkaline solution including a mercaptan oxidation catalyst are mixed in a mixing vessel in which mercaptans are converted to disulfides. The effluent withdrawn from the top of the mixing vessel is settled in a vessel to yield separate streams of air, liquid hydrocarbon product containing disulfides and an aqueous alkaline solution including catalyst.

U.S. Pat. No. 4,775,462 B1, which is incorporated by reference, teaches an alternative approach to removing mercaptan compounds from a hydrocarbon stream by thioetherification. In a thioetherification process the mercaptan compounds are reacted with olefinic hydrocarbons to form organic sulfides. Organic sulfides boil at higher temperatures than mercaptans and can be recovered in a high boiling stream of a fractionation column. Organic sulfides can also be completely converted to hydrogen sulfide and paraffins in a hydrotreating processes.

A paper titled, "Novel Process for FCC Gasoline Desulfurization and Benzene Reduction to Meet Clean Fuels Requirements," presented at the NPRA 2000 Annual Meeting on Mar. 26–28, 2000 in San Antonio, Tex., discloses that sulfur and aromatic species in FCC naphtha may be segregated using solvent extraction.

U.S. Pat. No. 5,582,714 B1 discloses a process for the removal of sulfur from FCC gasoline by employing a solvent. Preferred solvents are glycols and glycol ethers. U.S. Pat. No. 2,634,230 B1 discloses a process for desulfurization of high sulfur olefinic naphtha wherein 2, 4-dimethylsulfolane is employed to extract sulfur from a highly olefinic naphtha, such that the solvent does not affect separation between olefins and paraffins. Instead, the process produces a sulfur-lean raffinate phase and a sulfur-rich extract. It is also known to use solids as adsorbents or reactants to remove sulfur from hydrocarbon streams.

U.S. Pat. No. 2,792,332 B1 discloses a process for the removal of aromatics and sulfur compounds from a feedstream comprising heavy naphtha, aromatics and sulfur compounds wherein the feedstream comprising heavy naphtha is contacted in a first extraction column with a solvent combination comprising isopropyl alcohol and polyethylene glycol to obtain a concentrated aromatic fraction and a paraffinic-naphthenic raffinate. The raffinate is first distilled to remove the alcohol, the resulting alcohol depleted raffinate is water washed to remove traces of the polyethylene glycol and then dried before it is recycled for reprocessing with the feedstream. The extract phase is similarly processed to first remove the alcohol by distillation and the alcohol-free extract is steam distilled to recover an aromatic product and to provide an aromatic-free polyethylene glycol/water stream. The polyethylene glycol/water stream is then passed to a solvent recovery tower to distill off the remaining water. In a second extraction column, the concentrated aromatic fraction is contacted with pure polyethylene glycol to recover an aromatic extract, which is steam distilled to provide a purified aromatic product comprising aromatic sulfur-type compounds.

U.S. Pat. No. 4,781,820 B1 and U.S. Pat. No. 4,498,980 B1 disclose processes for the separation of aromatic and non-aromatic hydrocarbons from a mixed hydrocarbon feed wherein the feedstream is contacted with a solvent comprising a polyalkylene glycol and a co-solvent comprising a glycol ether.

U.S. Pat. No. 5,928,497 B1, U.S. Pat. No. 4,337,156 B1 and CA 2,087,926 B1 teach processes for adsorption of sulfur-containing compounds. U.S. Pat. No. 6,156,084 B1 discloses reacting organic sulfur compounds out of a stream by contacting it with a solid nickel reactant.

According to U.S. Pat. No. 3,957,625 B1, sulfur impurities tend to concentrate in the heavy fraction of gasoline. A method for removing sulfur includes hydrodesulfurization of the heavy fraction of the catalytically cracked gasoline so as to retain the octane contribution of the olefins which are found mainly in the lighter fraction.

Most of the sulfur present in the bottoms stream is in the form of thiophene, benzothiophene and their substituted derivative compounds which cannot be removed from naphtha except by hydrodesulfurization. U.S. Pat. No. 6,228,254 B1 discloses extracting remaining sulfur compounds after mild hydrotreating to reduce the sulfur concentration of the gasoline to a very low level without significantly reducing the octane number of the gasoline.

A reforming process described in N. Dachos, A. Kelly, D. Felch and E. Reis, *Handbook of Petroleum Refining Processes*, 4.3–4.26 (Robert A. Meyers, 2d ed., 1997) involves contacting hydrocarbon feed such as naphtha with platinum-containing catalysts at elevated temperatures and in the presence of hydrogen at pressures ranging from 345 to 3450 kPa (50 to 500 psig) to produce a high-octane liquid product that is rich in aromatic compounds. Chemical hydrogen, light gas and liquefied petroleum gas (LPG) are also produced as reaction by-products. Catalyst is subjected to continuous regeneration to burn off coke and maintain its activity. Because reforming processes are typically preceded by a hydrotreater unit, sulfur is not substantially present in the reformate. Reformer units typically preceded by a hydrotreater reactor are usually a component of a refinery complex. The reformer unit typically processes feeds such as straight run heavy naphtha from a central distillation unit and heavy hydrocracked naphtha from a hydrocracking unit.

Dividing wall columns include a partition in the distillation column near the exit for the middle stream to control the composition of the middle stream more precisely than can a side-draw column. The tighter specification on the boiling range of the middle stream allows for a reduction in the flow rate of the middle stream and improved operational control. Moreover, dividing wall columns often provide reduced capital cost, plot space requirements, and energy cost compared to a sequence of two distillation columns. U.S. Pat. No. 2,471,134 B1 and U.S. Pat. No. 4,230,533 B1 disclose dividing wall columns and are incorporated herein by reference.

The recovery of thiophene in the overhead stream is a key operational parameter of the naphtha fractionation column. Thiophene is the lowest boiling sulfur compound that will not be converted in a caustic mercaptan oxidation process. Ideally, the fractionation column would be operated such that the maximum amount of olefin-rich material is recovered overhead, provided that the sulfur content remaining in the overhead stream after any treatment is low enough that the refiner can meet the overall sulfur specification for the gasoline pool.

There are several problems intrinsic to operating fractionation with high recovery of olefins overhead. The amount of thiophene present in the column feed is usually unknown and may vary depending on the operating conditions in the FCC process. Thiophene exhibits strongly non-ideal vapor-liquid equilibrium mixtures with many of the other components present in naphtha from an FCC unit. Additionally, Desty, D. H. and Fidler, F. A., "Azeotrope Formation between Sulfur Compounds and Hydrocarbons," *Industrial and Engineering Chemistry*, 43(4), 905–910 (1951) reports that azeotropes are known to form between thiophene and many hydrocarbons with 6 to 8 carbons present in gasoline. Moreover, thiophene is difficult to detect in FCC naphtha. When the standard analysis of composition by gas chromatography is made, thiophene is aliased with sec-butyl mercaptan. Sec-butyl mercaptan is treatable using a caustic mercaptan oxidation process, but thiophene is not.

Because of these problems, a conservative design approach would be to operate the fractionation column at very low recovery of olefins overhead, sending a substantial part of the $C_6$ olefins to the bottoms stream. However, this results in a reduction of octane number due to the saturation of $C_6$ and $C_7$ olefins. Moreover, the increased consumption of hydrogen caused by olefin saturation in the hydrotreating process would result in increased cost.

Accordingly, it is an object of the present invention to operate a three-way splitter fractionation column with post-treatment unit operations such that the total sulfur in all three streams leaving the three-way splitter does not exceed a sulfur contribution allocated to FCC gasoline. It is a further object of the present invention to provide a simple control scheme for governing the flow rates of the overhead, middle and bottoms streams from the three-way gasoline fractionation column so that the aggregate streams after post-fractionation treatment do not exceed the limits on sulfur contribution from the FCC process.

SUMMARY OF THE INVENTION

The present invention comprises a fractionation column that may fractionate effluent from an FCC unit into a low boiling stream, a middle boiling stream and a high boiling stream. Either of the feed or the low boiling stream may be subjected to a mercaptan removal treatment. The high boiling stream is subjected to hydrotreating which will rid the high boiling stream of almost all organic sulfur compounds. The middle stream will comprise mostly $C_6$ and $C_7$ hydrocarbons and organic sulfur compounds including substantial concentrations of thiophenes. The middle boiling stream may be subjected to a sulfur treatment complex which may comprise a sulfur removal unit and/or a reforming unit which may already be present in the refinery. Effluent from the reformer is substantially free of organic sulfur compounds. The sulfur removal unit will send a thiophene-rich stream to be processed in the hydrotreater on the bottoms stream and a thiophene-lean hydrocarbon stream to be blended with the low boiling stream. Flowthrough lines allow portions of the middle boiling stream to join the low boiling stream and/or the high boiling stream at flow rates governed by a controller. The controller sets flow rates with input of sulfur concentration from an analyzer that monitors the low boiling stream downstream of mercaptan removal treatment, if used, and blending with the thiophene-lean hydrocarbon stream from the sulfur removal unit, if used.

The present invention will direct substantially all of the thiophene that survives post-fractionation treatment through the analyzer. By bypassing the middle stream around the sulfur removal unit, a refiner can reduce operating expenses that are typically more for a sulfur removal unit than for an mercaptan removal unit and can possibly delay the capital expenditure necessary to put in a sulfur removal unit of sufficient capacity to yield effluent that meets applicable organic sulfur concentration limits. The present invention may be especially useful when limits on organic sulfur concentration in FCC gasoline may be reduced to a lower level in the future because the invention will allow a refiner to delay the expenditure of putting in a larger sulfur removal unit until necessary.

Accordingly, in one embodiment, the present invention relates to an apparatus for removing organic sulfur compounds from a hydrocarbon stream. The apparatus comprises a fractionation column for fractionating a feed stream into an overhead stream, a middle stream and a bottoms stream. A bottoms line carries the bottoms stream from the fractionation column, and a reactor unit is in communication with the bottoms line. A hydrogen line is in communication with either the bottoms line or the reactor unit for delivering hydrogen gas thereto. An intermediate line carries the middle stream from the fractionation column. An overhead line carries at least a portion of the overhead stream from the fractionation column. A flowthrough line carries at least a portion of the middle stream to join at least a portion of the overhead stream. An analyzer determines the sulfur content of the overhead stream. Lastly, a flow control valve regulates the flow through the flowthrough line in response to the determination of sulfur content.

In another embodiment, the present invention relates to a process for removing sulfur from a hydrocarbon stream. The process comprises fractionating a feed stream into an overhead stream, a middle stream and a bottoms stream. Hydrogen is added to the bottoms stream which is hydrotreated. At least a portion of the overhead stream is analyzed for sulfur content. Lastly, a portion of the middle stream is added to the overhead stream at a rate in response to the analysis of the sulfur content of the portion of the overhead stream.

In a further embodiment, the process of the present invention further includes treating a portion of one of the feed stream and the overhead stream by a mercaptan removal process, and at least a portion of the overhead stream is analyzed for sulfur content downstream of the mercaptan removal process.

Additional objects, embodiments and details of this invention can be obtained from the following description of the invention.

BRIEF DESCRIPTION OF THE DRAWING

The FIGURE is a process flow scheme for the present invention.

DETAILED DESCRIPTION OF THE INVENTION

The process and apparatus of the present invention is effective for reducing the sulfur content of a hydrocarbon stream such as a gasoline stream. Although the invention will be described with primary emphasis on treating gasoline, other hydrocarbon feedstocks may be beneficially treated by the present invention. As used herein, a gasoline stream includes individual refinery streams suitable for use as a blend stock for gasoline, or a blended gasoline stream containing two or more streams, each of which are suitable for use as a gasoline blend stock. A suitable gasoline blend stock, when blended with other refinery streams, produces a combined stream which meets the applicable governmental requirements for gasoline. The present invention incorporates a gasoline distillation column which may be operated with maximum recovery of olefins while ensuring that the amount of sulfur compounds contributed to the gasoline pool does not exceed the maximum allowable limits.

The FIGURE provides an exemplary flow scheme of the present invention. Details such as pumps, instrumentation, heat exchange and heat recovery circuits, compressors and similar hardware have been omitted from the FIGURE as being non-essential to an understanding of how the invention operates. Use of such miscellaneous equipment is well within the purview of one skilled in the art.

A hydrocarbon feed stream such as a naphtha cut from the main column following an FCC unit is carried in a feed line 2 to a gasoline fractionation column 10. A mercaptan removal unit (not shown) may treat a stream prior to entering the feed line 2 to the gasoline fractionation column 10. Such a mercaptan removal unit may be a thioetherification unit or a mercaptan oxidation unit that need not be extractive. The resulting disulfides or sulfides will appear predominantly in the bottoms stream from the gasoline fractionation column 10 which will undergo hydrotreating. The hydrotreater reactor may be run to completely remove disulfide compounds from the liquid product stream of the hydrotreater reactor.

The gasoline fractionation column 10 splits the feed into three streams. An overhead line 12 carries a stream of low-boiling compounds having an end point of less than or equal to about 49° to 60° C. (120° to 140° F.) in the overhead from the gasoline fractionation column 10. An intermediate line 14 carries a middle stream of middle boiling compounds having a boiling range of about 49° to 104° C. (120° to 220° F.) from the gasoline fractionation column 10. A bottoms line 16 carries a heavy stream of high-boiling compounds having an initial boiling point of greater than about 104° C. (220° F.) from the bottoms of the gasoline fractionation column 10. A flowthrough line 18 communicates the intermediate line 14 with the overhead line 12 and a flowthrough line 20 communicates the intermediate line 14 with the bottoms line 16. Preferably, the flowthrough lines 18, 20 directly communicate the intermediate line 14 with the overhead line 12 and the bottoms line 20, respectively. The flowthrough line 18 is governed by a flow control valve 22 and the flowthrough line 20 is governed by a flow control valve 24. An intermediate process line 25 carries the remainder of the intermediate line 14 not diverted through flowthrough lines 18, 20. The flow of the intermediate process line 25 is governed by a flow control valve 32.

The overhead line 12 of a low-boiling fraction may be delivered to an optional mercaptan removal unit 26 or left untreated especially if a mercaptan removal unit was used to pretreat the feed in the feed line 2. The intermediate line 14 of the mid-boiling fraction may preferably be delivered to a sulfur treatment complex 29 comprising a reformer unit 34 and/or a sulfur removal unit 28 such as a solvent extraction unit, an extractive distillation unit or a sulfur adsorption unit. The bottoms line 16 with the high-boiling fraction is delivered to a hydrotreater unit 30. The hydrotreater unit 30 is run at conditions sufficient to hydrogenate all of the sulfur contained in organic compounds to produce hydrogen sulfide.

A portion of the intermediate process line 25 may be diverted to the catalytic reformer unit 34 through reformer feed line 37 governed by the flow control valve 33. Typically, feed to the reformer unit 34 will be desulfurized by hydrotreater 35 before entering a catalytic reformer 39, precipitating the complete removal of sulfur compounds including thiophene from the reformer feed. The effect of catalytic reforming is to increase the octane value of the middle stream by a substantial amount, thereby increasing the octane value of the resulting gasoline pool. Hence, the flow to the reformer unit 34 through the intermediate process line 25 should be maximized to enhance the octane value of the middle stream subject to meeting the benzene concentration limit.

A removal feed line 43 introduces a portion of intermediate process line 25 not diverted to the reformer unit 34 to the sulfur removal unit 28. Thiophene may be removed from the portion of the middle stream in the removal feed line 43 by a sulfur compound adsorption process, by an aromatic extraction process or by a process in which solids react with sulfur compounds to remove them from the process stream. A purified portion in a purified line 62 containing thiophene-lean gasoline may be blended entirely with the overhead line 12 or a mercaptan removal effluent line 44 from the mercaptan removal unit 26, if one is used, to form a treated overhead line 112 and may then be blended with the gasoline pool. If extraction is used in the sulfur removal unit 28, the extract portion from the sulfur removal unit 28 in a removal effluent line 68 will contain non-aromatic sulfur-containing compounds, thiophene and aromatic hydrocarbons; the relative proportions of each will depend on the method of extraction used. If sulfur adsorption or sulfur reaction is used in the sulfur removal unit 28, the regenerant stream from periodic regeneration may be processed through the removal effluent line 68. The removal effluent line 68 delivers the extract portion to the hydrotreater unit 30.

The hydrotreater feed line 71 carries a combination of the bottoms line 16 from the gasoline fractionation column 10, the flowthrough line 20 from the intermediate line 14 and the removal effluent line 68 from the sulfur removal unit 28 to the hydrotreater unit 30. The hydrotreater unit 30 is run to hydrodesulfurize all or most of the compounds in the hydrotreater feed line 71.

The flow control valves 22, 24, 32 should be set to preserve higher octane value by maximizing the amount of the mid-boiling fraction in the intermediate line 14 that is diverted to the overhead line 12 that most fully preserves the olefins. Although the reformer unit 34 improves octane value and the sulfur removal unit 28 does not significantly diminish octane value, they are both more expensive to run than the mercaptan removal unit 26 per quantity of hydrocarbon processed especially when factoring in capital intensity. On the other hand, the amount of mid-boiling fraction that is sent to the hydrotreater unit 30 should be minimized. Although hydrotreating provides for a complete desulfurization of the bottoms line 16 except for some recombinant mercaptans, it reduces the octane value by saturating all olefins which generally have higher octane value than their paraffinic counterparts. Hence, portions of the intermediate line 14 should be diverted to the bottoms line 16 only when the overhead line 12 has a sulfur concentration that would exceed allowable limits and the throughput to the sulfur treatment complex 29 is at capacity.

The hydrotreater unit 30 should be run to assure that no thiophene compounds will make it through without being converted to hydrogen sulfide and hydrocarbons. Consequently, the effluent in a hydrotreated product line 98 from the hydrotreater unit 30 on the bottoms line 16 will require no monitoring for thiophene compounds. For the same reason, because the reformer unit 34 is preceded by a hydrotreater 35, it will also require no monitoring for thiophene compounds. Moreover, most of the thiophene from the sulfur removal unit 28 will be carried, for example, in the removal effluent line 68 to join the bottoms line 16 that will be hydrotreated. The remaining thiophene in the purified line 62 will be delivered to the treated overhead line 112 after the mercaptan removal unit 26, if one is used. Hence, all of the thiophene compounds surviving post-fractionation treatment will be present only in the treated overhead line 112.

The treated overhead line 112 should be quantitatively monitored for sulfur content before it is sent to gasoline blending. A substantial fraction of the sulfur compounds in the treated overhead line 112 will be thiophene compounds. Because all three streams 12, 14, 16 from the gasoline fractionation column 10 will preferably be eventually mixed in the gasoline pool after treatment, the diversion of the intermediate line 14 to the overhead line 12 will depend upon the sulfur content of the treated overhead line 112. If the concentration of sulfur in the treated overhead line 112 is such that it would exceed an allowable contribution of sulfur to the gasoline pool, less of the middle boiling stream in the intermediate line 14 should be directed to the overhead line 12 through flowthrough line 18. However, if analysis of the overhead line 12 indicates that the concentration of sulfur in the overhead line 12 is below the maximum allowable sulfur contribution to the gasoline pool, more of the middle boiling stream in the intermediate line 14 should be diverted to the overhead line 12 through flowthrough line 18. This preserves olefins in the overhead line 12 and reduces the extent of operation required of the sulfur removal unit 28.

The control scheme to be described is preferred for the present invention. However, other control schemes that provide the same result may also be suitable. An analyzer 100 periodically or continuously monitors the composition of the treated overhead line 112. The analyzer 100 monitors for sulfur compound concentration which will have a substantial thiophene concentration. Because the analyzer 100 monitors total sulfur concentration, there is no need to distinguish thiophene from other types of organic sulfur compounds. The analyzer 100 signals the sulfur concentration to a controller 102 which compares the sulfur concentration against a preset amount. The preset amount will be the maximum amount of sulfur contribution to the gasoline pool allowed for FCC gasoline. When the sulfur concentration exceeds the preset amount, the controller 102 will signal the flow control valve 22 on the flowthrough line 18 to close by an appropriate amount and the flow control valve 32 on the intermediate process line 25 to open by a corresponding amount. The flow control valve 24 remains unchanged, allowing the minimum amount of the middle boiling stream in the intermediate line 14 to be treated by the hydrotreater unit 30. The controller 102 monitors whether the flow control valve 32 is opened to a preset limit indicating the sulfur removal unit 28 is at maximum capacity. When the flow control valve 32 reaches the preset limit, the controller 102 will signal to open the control valve 24 to admit more of the middle stream in the intermediate line 14 to the hydrotreater unit 30 through the flowthrough line 20 instead of opening the flow control valve 32 more in response to the analyzer 100 indicating that the treated overhead stream has too high a concentration of sulfur. The hydrotreater unit 30 is able to convert all of the thiophene in the feed to hydrocarbons and hydrogen sulfide which can be removed from the hydrocarbons.

Feed to the process of the present invention preferably comprises a sulfur-containing petroleum fraction which boils in the gasoline boiling range, including gasoline from an FCC unit, coker pentane/hexane, coker naphtha, straight run gasoline, and mixtures containing two or more of these streams. Such gasoline blending streams typically have a normal boiling point within the range of about 0° to about 216° C. (32° to 420° F.). Feeds of this type include light naphthas typically having a boiling range from about $C_6$ to about 166° C. (330° F.); full range naphthas, typically having a boiling range from about $C_5$ to about 216° C. (420° F.); heavier naphtha fractions boiling in the range from about 127° to about 218° C. (260° to 425° F.). In general, a gasoline motor fuel will distill over the range from about room temperature to about 218° C. (425° F.).

In general, gasoline streams suited for treating in the present process contain greater than about 10 ppm thiophenic compounds. Typically, streams containing more than 40 ppm thiophenic compounds, up to 2000 ppm thiophenic compounds and higher may be treated. After treatment according to the present invention, the sulfur content may be reduced to the desired amount.

The total sulfur content of the gasoline stream to be desulfurized in the present invention will generally exceed 50 ppm by weight and typically range from about 150 ppm to as much as several thousand ppm sulfur. For fractions containing at least 5 vol-% that boils over about 193° C. (380° F.), the sulfur content may exceed about 1000 ppm by weight and may even exceed 4000 to 5000 ppm by weight.

The gasoline fractionation column 10 is a three-way splitter to assure that an insubstantial fraction of the thiophene is fractionated into the overhead stream. A two-way splitter would provide substantial fractions of thiophene in both the overhead and the bottoms lines. The fractionation column 10 is preferably a dividing wall column. The reboiler and condensing units that may be part of the equipment of the gasoline fractionation column 10 are not shown in the FIGURE.

The gasoline fractionation column 10 is preferably operated at a pressure from about 35 to about 1379 kPa (5 to 200 psig) to produce a low-boiling fraction predominantly containing $C_5$ and smaller hydrocarbons including mercaptan sulfur compounds and olefins. The low-boiling fraction preferably boils in the range from about 38° to about 82° C. (100° to 180° F.) and preferably has an end boiling point below about 60° C. (140° F.) and more preferably below about 49° C. (120° F.).

A large amount of sulfur can be withheld from the gasoline pool by use of a mercaptan removal unit which may be placed in two alternative locations relative to the gasoline fractionation column 10. The first alternative is locating the mercaptan removal unit 26 on the overhead line 12 to treat the low-boiling fraction. The mercaptan removal unit 26 may comprise a thioetherification unit. A preferred mercaptan removal unit 26 is a mercaptan oxidation unit which is shown in the exemplary configuration as an extractive mercaptan oxidation unit in the FIGURE.

On entering the mercaptan removal unit 26, the overhead line 12 joined by flowthrough line 18 is prewashed with a mild alkaline solution in a prewash vessel 36 to convert hydrogen sulfide to a sulfide salt. Mild alkaline solution with sulfide salts dissolved therein are withdrawn from the bottom of the prewash vessel 36 in a line 38. The prewashed hydrogen stream is fed through a line 40 to an extractor vessel 42 and is contacted with an aqueous alkaline solution to selectively extract a majority of the mercaptan sulfur compounds and leave an extracted hydrocarbon product withdrawn through the mercaptan removal effluent line 44. The slightly acidic mercaptans in the presence of a strong base tend to form mercaptide salts which are preferentially soluble in a basic solution. The resulting mercaptide-rich alkaline stream used to extract mercaptans from the hydrocarbon is then withdrawn through a line 46. Air is added by a line 47 to either the line 46 or to an oxidation reactor 48 to regenerate the mercaptide-rich alkaline stream by catalytic oxidation in the oxidation reactor 48 to convert mercaptide salts to disulfides which are immiscible in the alkaline stream. A line 50 carries the disulfides and alkaline stream to a settler 52. The major portion of disulfide compounds are typically separated from the alkaline stream by settling. Air is vented in a line 56 and disulfides are withdrawn in a line 58 from the settler 52. The regenerated alkaline stream withdrawn in the line 54 is then recycled to the extractor vessel 42 to be used for extraction. The extracted gasoline product in the mercaptan removal effluent line 44 contains thiophenes and some disulfides. Hence, it is important that the regenerated alkaline stream in the line 54 recycled to the extractor vessel 42 contain a low level of disulfide compounds, preferably less than about 50 wppm sulfur, to minimize their sulfur contributed to the gasoline pool by the treated low-boiling fraction.

The second alternative is locating a mercaptan removal unit which may comprise a thioetherification unit or a mercaptan oxidation unit, which need not be extractive, prior to the feed line 2 to the gasoline fractionation column 10. Neither configuration is shown in the FIGURE. In a sweetening mercaptan oxidation process, the gasoline feed is mixed with air and oxidized over activated charcoal impregnated with oxidation catalyst in the presence of a continuously injected weak alkali stream. The mercaptans in the feed are oxidized to disulfides which remain in the sweetened gasoline. The alkali is settled out of the sweetened gasoline product and returned to the oxidation. The disulfide-rich, mercaptan-lean gasoline may then be fed to the gasoline fractionation column 10. Most of the disulfides in the feed line 2 will end up in the high-boiling fraction of the bottoms line 16 and be hydrotreated.

The mercaptan removal unit 26 that may treat the overhead line 12 will require less capacity than the alternate mercaptan removal unit prior to the feed line 2 because the flow rate of the overhead line 12 will be a fraction of the flow rate of the feed line 2. The mercaptan removal unit 26 on the overhead line 12 is preferably extractive mercaptan oxidation to rid the overhead line of disulfides before entering the gasoline pool. However, the mercaptan removal unit 26 on feed line 2 or the mercaptan removal unit 26 on overhead line 12 will not remove thiophene from the hydrocarbon stream.

The alkaline solution utilized in the present invention may comprise any alkaline reagent known to have the capability to extract mercaptans from the low-boiling hydrocarbon fraction. A preferred alkaline solution generally comprises an aqueous solution of an alkali metal hydroxide, such as sodium hydroxide, potassium hydroxide and lithium hydroxide. A particularly preferred alkaline solution for use in the present invention is an aqueous solution of about 1 to about 50% by weight of sodium hydroxide with particularly good results obtained with aqueous solutions having about 4 to about 25 wt-% sodium hydroxide.

The catalyst, which is used in the oxidation step, is preferably a metal phthalocyanine catalyst. This invention does not require the use of a specific mercaptan oxidation catalyst. Many suitable catalysts are known in the art. One preferred class of catalyst comprises sulfonated metal phthalocyanine. A particularly preferred sulfonated metal phthalocyanine is highly monosulfonated cobalt phthalocyanine prepared by the method of U.S. Pat. No. 4,049,572 B1, the teachings of which are herein incorporated by reference. Other phthalocyanine catalysts are described in U.S. Pat. No. 4,897,180 B1. Additional dipolar-type catalysts that are suitable for use in an alkaline contacting solution are described in U.S. Pat. No. 4,956,324 B1; U.S. Pat. No. 3,923,645 B1; U.S. Pat. No. 3,980,582 B1 and U.S. Pat. No. 4,090,954 B1. Typically, the oxidation catalyst in the aqueous alkaline solution will have a concentration of 10 to 500 wppm and preferably a concentration of 200 wppm. Particularly preferred metal phthalocyanines comprise cobalt phthalocyanine and iron phthalocyanine. Other suitable metal phthalocyanines include vanadium, copper, nickel, molybdenum, chromium, tungsten, magnesium, platinum, hafnium and palladium. Particularly preferred polar derivatives are the sulfonated derivatives such as the monosulfo derivative, the disulfo derivative, the tri-sulfo derivative and the tetra-sulfo derivative.

The preferred phthalocyanine catalyst can be used in the present invention in one of two modes. First, it can be utilized in a water-soluble form or a form which is capable of forming a stable emulsion in water as disclosed in U.S. Pat. No. 2,853,432 B1. Second, the phthalocyanine catalyst can be utilized as a combination of a phthalocyanine compound with a suitable carrier material as disclosed in U.S. Pat. No. 2,988,500 B1. In the first mode, which is preferred for the extractive mercaptan oxidation, the catalyst is present as a dissolved or suspended solid in the alkaline stream, which is charged to the regeneration step. In this mode, the preferred catalyst is cobalt or vanadium phthalocyanine disulfonate, which is typically utilized in an amount of about 5 to about 1,000 wppm of the alkaline stream. In the second mode of operation, which is preferred for the sweetening mercaptan oxidation, the catalyst is preferably utilized as a fixed bed of particles of a composite of the phthalocyanine compound with a suitable carrier material. The carrier material should be insoluble or substantially unaffected by the alkaline stream or hydrocarbon stream under the conditions prevailing in the various steps of the process. Activated charcoals are particularly preferred because of their high adsorptivity under these conditions. The amount of the phthalocyanine compound combined with the carrier material is preferably about 0.1 to about 2.0 wt-% of the final composite. Additional details as to alternative carrier materials, methods of preparation, and the preferred amount of catalytic components for the preferred phthalocyanine catalyst for use in this second mode are given in the teachings of U.S. Pat. No. 3,108,081 B1.

The mercaptan removal unit either upstream of the feed line 2 or on the overhead line 12 may be a thioetherification unit. In a thioetherification unit, the mercaptan compounds are reacted with olefinic hydrocarbons to form organic sulfides. Organic sulfides are higher boiling than mercaptans and can be recovered and directed to join the bottoms line 16 if the thioetherification unit processes the low-boiling stream in the overhead line 12. If the thioetherification pretreats the feed in line 2, the fractionation column 10 will fractionate the sulfides to the heavy stream in the bottoms line 16. Organic sulfides are completely converted to hydrogen sulfide and paraffins in a hydrotreating process.

A mid-boiling fraction is removed from the gasoline fractionation column 10 by intermediate line 14 predominantly containing $C_6$ and $C_7$ hydrocarbons and including disulfides, thiophenes and olefins. If the feed in the feed line 2 to the gasoline fractionation column 10 is not pretreated by a mercaptan removal process, the mid-boiling fraction will also include mercaptans. The mid-boiling fraction preferably boils in the range from about 38° to about 104° C. (100° F. to 220° F.) and preferably has an end boiling point below about 121° C. (250° F.). The gasoline fractionation column 10 will preferably be designed so that the flow rate of the intermediate line 14 may vary between 0 and 30 wt-% of the feed flow rate. In an embodiment, the flow rate of the intermediate line 14 will be between 10 and 30 wt-% of the column feed. Under conditions when the thiophene concentration in the feed is relatively high, the flow rate of the intermediate line 14 will be higher, approaching 30 wt-% of the feed flow rate. Under this condition, almost all of the $C_6$ to $C_7$ fraction in which the thiophene accumulates will exit in the intermediate line 14. Under conditions in which the thiophene concentration in the feed is low, the flow rate of the intermediate line 14 may be reduced, approaching 10–15 wt-% of the feed flow rate.

A portion of the mid-boiling fraction from the intermediate line 14 that is not withdrawn by flowthrough lines 18, 20 is carried by the intermediate process line 25 at a flow rate governed by the flow control valve 32. The intermediate process line 25 is split into a reformer feed line 37 and a removal feed line 43. The portion of the mid-boiling fraction in removal feed line 43 is treated by the sulfur removal unit 28. In an exemplary embodiment, the sulfur removal unit 28 is a liquid—liquid sulfur extractor vessel 60. The mid-boiling fraction in the removal feed line 43 is contacted with a solvent in the extractor vessel 60 which is selective to remove thiophene from the mid-boiling fraction. The liquid—liquid sulfur extractor vessel 60 may operate at a capacity and efficiency necessary to reduce thiophene concentration down to very low levels. The selective solvents are water-miscible organic liquids at the operating temperature of the process. Furthermore, the selective solvents must have a boiling point and a decomposition temperature higher than the operating temperature of the process. The operating temperature is the liquid—liquid extraction temperature at which the feedstock is contacted with the solvent and the solvent regeneration temperature which is typically 38° to 60° C. (100 to 140° F.). Water-miscible solvents are completely miscible with water over a wide range of temperatures, which have a high partial miscibility with water at room temperature, and which are completely miscible with water at operating temperatures.

Selective solvents employed in the present invention may be low molecular weight, preferably having a molecular weight less than about 400 and more preferably less than about 200. Examples of such solvents include polyalkylene glycols and polyalkylene glycol ether. In general, any suitable solvent which demonstrates the desired characteristics herein described may be utilized in the present invention. Such selective solvents may include, for example, sulfolane, furfural, n-formyl morpholine, n-methyl 2-pyrrolidone, dimethyl sulfoxide, pentaethylene glycol, dimethyl formamide, tetra-ethylene glycol, methoxyl-tri-glycol alcohols such as isopropyl alcohol and blends thereof. The extraction of thiophene in extractor vessel 60 can be made to operate at high recovery by circulating more and more solvent. The extracted thiophene-lean gasoline exits in the purified line 62 from the extractor vessel 60 to join the low-boiling fraction in the overhead line 12 or the mercaptan removal effluent line 44 if the mercaptan removal unit 26 is used. The resulting thiophene-rich solvent containing some olefins exits in an extract line 64 of the extractor vessel 60 and is stripped in a column 66 to recover a hydrocarbonaceous stream rich in thiophene in the removal effluent line 68 and a lean solvent which is returned by a solvent line 70 from the bottoms to the extractor vessel 60. The thiophene-rich hydrocarbonaceous stream in the removal effluent line 68 is joined with the high-boiling fraction in the bottoms line 16 to undergo hydrotreating. Because much of the unsaturated hydrocarbons in the removal effluent line 68 are aromatic, mild hydrotreatment will not saturate them, thus preserving their octane contribution.

In another embodiment of the present invention, the mid-boiling fraction containing thiophene and olefins may be separated by extractive distillation to produce a raffinate stream containing olefins and having a reduced thiophene content and thereby a reduced sulfur content relative to the mid-boiling fraction, and an extract stream enriched in thiophene. The extractive distillation may be conducted while using any of the above-mentioned solvents which extract thiophene. Extractive distillation is well known to those skilled in the art.

Usually a refinery has a catalytic reformer unit 34 in operation for processing straight run heavy naphthas and heavy hydrocracked naphtha streams. A portion of the capacity of the existing reformer unit may be allocated to processing a portion of the mid-boiling fraction in the reformer feed line 37. A reformer unit 34 is typically preceded by a hydrotreater unit 30. The hydrotreater unit 30 rids the intermediate line 14 of all organic sulfur compounds and the reformer unit 34 gives a boost in octane value. Preferably, all of the middle stream in intermediate line 14 would be directed to the reformer unit. However, gasoline typically has a benzene concentration limit. Benzene precursors such as $C_6$ and $C_7$ hydrocarbons will predominantly be found in the middle boiling stream in intermediate line 14. Catalytic reforming will convert a majority of such benzene precursors to benzene. Hence, the concentration of benzene in the reformer effluent will limit the amount of the middle boiling stream that may be reformed, unless the refiner wants to make aromatic hydrocarbons for use as petrochemical feedstock. The practical alternative is to construct the sulfur removal unit 28 that would process the bulk of the mid-boiling fraction.

Water and sulfur must be removed from the mid-boiling fraction in the reformer feed line 37 before undergoing reforming to avoid adverse reforming reaction conditions. Water may be removed by typical methods such as by a dryer 27 employing a desiccant. Sulfur may be removed by a hydrotreater 35 which converts organic sulfur compounds including thiophene to hydrogen sulfide and hydrocarbons. Hydrogen sulfide can be removed from the mid-boiling fraction, thereby preventing the sulfur from entering the downstream gasoline pool.

A dried and hydrodesulfurized mid-boiling fraction in a hydrotreater effluent line 49 and a hydrogen-rich gas from a line 51 are preheated and charged to the catalytic reformer 39 containing typically two to five reactors in series. Suitable heating means are provided between reactors to compensate for the net endothermic heat of reaction in each of the reactors. Reactants may contact the catalyst in individual reactors in either upflow, downflow or radial flow fashion, with the radial flow mode being preferred. The catalyst is contained in a fixed-bed system or, preferably, in a moving-bed system with associated continuous catalyst regeneration. Alternative approaches to reactivation of deactivated catalyst are well known to those skilled in the art, and include semi-regenerative operation in which the entire unit is shut down for catalyst regeneration and reactivation or swing-reactor operation in which an individual reactor is isolated from the system, regenerated and reactivated while the other reactors remain on-stream. The preferred continuous catalyst regeneration in conjunction with a moving-bed system is disclosed, inter alia, in U.S. Pat. No. 3,647,680 B1; U.S. Pat. No. 3,652,231 B1; U.S. Pat. No. 3,692,496 B1 and U.S. Pat. No. 4,832,921 B1, all of which are incorporated herein by reference.

Effluent from the reformer reactors is passed through a cooler to a separation zone, typically maintained at about 0° to 65° C., wherein a hydrogen-rich gas is separated from a liquid stream of unstabilized reformate. The resultant hydrogen stream can then be recycled through suitable compressing means through the line 51 back to the catalytic reformer 39. The liquid phase from the separation zone is typically withdrawn and processed in a fractionating system in order to adjust the butane concentration, thereby controlling front-end volatility of the resulting reformate. The reformer effluent line 31 recovers reformate from the catalytic reformer 39 with improved octane value and very few organic sulfur compounds.

The effluent from the reformer unit 34 will have to be monitored for benzene to ensure it is kept below maximum limits in the gasoline pool. Hence, the flow of the intermediate process line 25 to the reformer unit 34 is subject to the limit that the effluent from the reformer unit 34 does not exceed the maximum contribution of benzene to the gasoline pool. An analyzer 41 may periodically or continuously monitor the effluent in the reformer effluent line 31 to determine whether it exceeds the maximum benzene contribution. The analyzer signals the flow control valve 33 which shuts by an appropriate amount to bring the effluent in reformer effluent line 31 to within limits. If the analyzer 41 determines that the effluent in reformer effluent line 31 is below benzene limits, the flow control valve 33 may open more in response to the signal to maximize the amount of middle boiling stream that is sent to the reformer unit 34.

Reforming conditions applied in the reforming process of the present invention include a pressure selected within the range of about 100 kPa to 7 MPa (abs). Particularly good results are obtained at low pressure, namely a pressure of about 350 to 2500 kPa (abs). Reforming temperature is in the range from about 315° to 600° C., and preferably from about 425° to 565° C. As is well known to those skilled in the reforming art, the initial selection of the temperature within this broad range is made primarily as a function of the desired octane of the product reformate considering the characteristics of the charge stock and of the catalyst. Ordinarily, the temperature then is thereafter slowly increased during the run to compensate for the inevitable deactivation that occurs to provide a constant octane product. Sufficient hydrogen is supplied to provide an amount of about 1 to about 20 moles of hydrogen per mole of hydrocarbon feed entering the reforming zone, with excellent results being obtained when about 2 to about 10 moles of hydrogen are used per mole of hydrocarbon feed. Likewise, the liquid hourly space velocity (LHSV) used in reforming is selected from the range of about 0.1 to about 20 $hr^{-1}$, with a value in the range of about 1 to about 5 $hr^{-1}$ being preferred.

A preferable catalyst for the reformation process includes a platinum-group metal component of 0.01 to 2 wt-%, a halogen component of 0.1 to 10 wt-%, a tin component of 0.01 to 5 wt-%, an indium component of 0.1 to 5 wt-% and cerium component of 0.05 to 5 wt-% on a refractory inorganic oxide support having a surface area of 25 to 500 $m^2/g$. The typical catalyst is fully described in U.S. Pat. No. 6,013,173 B1, which is incorporated herein by reference.

The gasoline fractionation column 10 also produces a high-boiling fraction predominantly containing $C_8$ and heavier hydrocarbons and sulfur compounds. The high boiling fraction preferably boils in the range from about 66° to about 218° C. (150° to 425° F.). The resulting high-boiling fraction in the bottoms line 16 comprising sulfur compounds is joined with an middle boiling range fraction from flowthrough line 20 and the removal effluent line 68 containing thiophene from the sulfur removal unit 28 and delivered to the hydrotreater unit 30 in a hydrotreater feed line 71. The hydrotreater feed line 71 is mixed with hydrogen from a line 72 and indirectly heat exchanged in a heat exchanger 73 with effluent in a reactor effluent line 74 from a hydrotreater reactor 76. The hydrotreater feed line 71 is further heated by a charge heater 78 and introduced into the hydrotreater reactor 76 via a preheated feed line 75. In the hydrotreater reactor 76, the hydrotreater feed is contacted with one or more beds of the same or different catalysts. Additional hydrogen is added to the hydrotreater reactor 76 through a line 80. The effluent in the reactor effluent line 74 from the hydrotreater reactor 76 is indirectly heat exchanged with the hydrotreater feed line 71 in the heat exchanger 73. Wash water is added to the reactor effluent line 74 through a line 77. The reactor effluent line 74 is then cooled in a cooler 79 and enters a separator 82. Sour water leaves the separator 82 through a line 83. Hydrogen leaves the separator 82 through a line 84 to be added to a line 86 which is compressed by one or more compressors 88 to be distributed to the hydrotreater reactor 76 through the lines 72, 80. Separated hydrotreater effluent is delivered by a line 90 to a stripping vessel 92. Steam is added to the stripping vessel 92 through a line 94. Light ends including steam and hydrogen sulfide are stripped from the hydrotreater effluent and leave through the light ends line 96 while the hydrotreated hydrocarbon product leaves through a hydrotreated product line 98 which can be blended in the gasoline pool.

In addition to the desulfurization of the hydrocarbonaceous compounds, it is contemplated that other reactions may also be performed in one or more sequential catalyst beds including hydrocracking, hydroisomerization, dealkylation and alkylation, for example. The primary goal of the hydrotreater reactor 76 is to remove sulfur from the hydrocarbon compounds by converting it to hydrogen sulfide. In addition, an equally important function is the improvement of the octane rating of the hydrocarbon stream exiting the hydrotreater reactor 76. The octane improvement may be the result of any of the hereinabove-described reactions.

One type of preferred catalyst useful in the hydrotreater reactor 76 of the present invention is a conventional hydrotreating catalyst containing 5 to 25 wt-% of a metal from Group VI and 0.5 to 10 wt-% of a metal from Group VIII calculated by total catalyst weight incorporated with a low acid inorganic oxide such as alumina, for example. Such catalysts do not have cracking activity because they are non-zeolitic, non-acidic catalysts which function to promote hydrodesulfurization reactions and are well known in the art. The hydrotreating components in the catalyst may be in the oxide or sulfide form. If a combination of at least a Group VI and a Group VIII metal component is present as oxides, it will preferably be subjected to presulfiding prior to use. Suitably the hydrodesulfurization catalyst comprises one or more components of nickel and/or cobalt and one or more components of molybdenum and/or tungsten.

Another type of preferred catalyst useful in the process of the present invention is a catalyst having hydrodesulfurization capability as well as the ability for hydroisomerization. Commercial catalysts of this type generally contain a zeolitic component. Any catalyst which performs hydrodesulfurization and hydroisomerization in combination is suitable for use in the process of the present invention. U.S. Pat. No. 5,817,595 B1 discloses such a suitable catalyst which is incorporated herein by reference.

Hydroisomerization conditions will vary depending upon the exact catalyst and feedstock to be used and the final product which is desired. Another type of preferred catalyst which may be used in the present invention is a catalyst which performs selective hydrodesulfurization without complete olefin saturation.

Hydrotreating operating conditions preferably include a reaction temperature from about 149° to about 343° C. (300 to 650° F.), a reaction pressure from about 345 to about 4137 kPa (50 to 600 psig) and a liquid hourly space velocity from about 0.5 to about 12 $hr^{-1}$.

EXAMPLES

We conducted a simulation to highlight the benefits of the present invention. In the Examples, feed from an FCC unit is assumed to contribute about one-third of the volume of the gasoline pool. The FCC feed unit used in the simulation has a typical distribution of olefins and organic sulfur compounds broken out into mercaptans, disulfides, thiophenes and benzothiophenes.

The gasoline feed is fractionated into three streams. In Examples 1–3, post-fractionation treatment includes subjecting the low boiling stream to extractive mercaptan oxidation, the middle boiling stream to sulfur extraction and the high boiling stream to hydrotreating. The hydrotreating process is operated under high severity to achieve a low sulfur concentration in the treated product. This causes all of the olefins in the hydrotreated stream to be saturated.

EXAMPLE 1

In Example 1, the post-fractionation treatment is operated to ensure that the total contribution of sulfur compounds to the gasoline pool is no more than 10 ppm by weight of the total gasoline pool. Because the FCC gasoline will contribute one-third of the gasoline in the pool, the three post-fractionation streams can contribute no more than 30 ppm by weight. Table 1 gives the distribution of sulfur and olefin contributions in the feed and from each post-fractionation stream and the total sulfur and olefin contribution to the gasoline pool for Example 1. In Example 1, the total olefin contribution of three streams is 24.25% of the product which is down from 30% in the feed.

TABLE I

| S Distribution (ppm) | Feed | Light | Middle | Heavy | Mercaptan Oxidated Light | Extracted Middle | Hydro-treated Heavy |
|---|---|---|---|---|---|---|---|
| Mercaptans | 400 | 180 | 200 | 20 | 0 | 2 | 10 |
| Disulfides | 20 | 0 | 20 | 0 | 5 | 1 | 0 |
| Thiophenes | 400 | 10 | 100 | 290 | 10 | 1 | 0 |
| Benzothiophenes | 1500 | 0 | 0 | 1500 | 0 | 0 | 0 |
| Total | 2320 | 190 | 320 | 1810 | 15 | 4 | 10 |
| Pool contribution | 773.3 | 63.3 | 106.7 | 603.3 | 5 | 1.3 | 3.3 |
| Olefins %, pool basis | 30 | 10 | 15 | 5 | 10 | 14.25 | 0 |
| Total olefins % in product | 24.25 | | | | | | |
| Pool sulfur ppm in product | 9.7 | | | | | | |

EXAMPLE 2

In Example 2, the same feed was subjected to the same treatment, but the total sulfur contribution to the gasoline pool is allowed to reach 30 ppm which means the FCC gasoline could contain 90 ppm of organic sulfur compounds. To exploit the additional sulfur allowance, a portion of the middle stream is allowed to bypass the extraction process and is mixed with the treated light and heavy streams and the treated remainder of the middle stream. The use of such a bypass operation reduces the volume of middle stream to be treated, and hence reduces the size and cost of extraction process required.

TABLE II

| S Distribution (ppm) | Feed | Light | Middle | Heavy | Mercaptan Oxidated Light | Extracted Middle | Blended Middle | Hydro-treated Heavy |
|---|---|---|---|---|---|---|---|---|
| Mercaptans | 400 | 180 | 200 | 20 | 0 | 1.62 | 38 | 10 |
| Disulfides | 20 | 0 | 20 | 0 | 5 | 0.81 | 3.8 | 0 |
| Thiophenes | 400 | 10 | 100 | 290 | 10 | 0.81 | 19 | 0 |
| Benzothiophenes | 1500 | 0 | 0 | 1500 | 0 | 0 | 0 | 0 |
| Total | 2320 | 190 | 320 | 1810 | 15 | 3.24 | 60.8 | 10 |
| Pool contribution | 773.3 | 63.3 | 106.7 | 603.3 | 5 | 1.08 | 20.27 | 3.3 |
| Olefins %, pool basis | 30 | 10 | 15 | 5 | 10 | 11.54 | 2.85 | 0 |
| Total olefins % in product | 24.39 | | | | | | | |
| Pool sulfur ppm in product | 29.68 | | | | | | | |

Table II gives the distribution of sulfur contributions from each stream and the total sulfur contribution to the gasoline pool, as well as the olefin contribution. The total olefin content slightly increases to 24.39% which will bring about an equivalent increase in octane number. The bypass of middle fraction sends more of the olefins to mercaptan oxidation, which retains almost all olefins, than to the extraction process, which loses about 5% of the olefins. The total contribution of sulfur to the gasoline pool is 29.68 ppm on a pool basis which is below the maximum 30 ppm. In Example 2, 19% of the middle fraction is bypassed around the extraction process, therefore the size of extraction plant is 81% of the capacity of Example 1.

EXAMPLE 3

In Example 3, a feed with a lower sulfur concentration is subjected to the same treatment as in Example 2 with an applicable maximum gasoline pool sulfur concentration of 30 ppm.

TABLE III

| S Distribution (ppm) | Feed | Light | Middle | Heavy | Mercaptan Oxidated Light | Extracted Middle | Blended Middle | Hydro-treated Heavy |
|---|---|---|---|---|---|---|---|---|
| Mercaptans | 160 | 90 | 50 | 20 | 0 | 0.235 | 26.5 | 10 |
| Disulfides | 10 | 0 | 10 | 0 | 5 | 0.235 | 5.3 | 0 |
| Thiophenes | 200 | 10 | 60 | 130 | 10 | 0.282 | 31.8 | 0 |
| Benzothiophenes | 700 | 0 | 0 | 700 | 0 | 0 | 0 | 0 |
| Total | 1070 | 100 | 120 | 850 | 15 | 0.752 | 63.6 | 10 |
| Pool contribution | 356.7 | 33.3 | 40 | 283.3 | 5 | 0.251 | 21.2 | 3.3 |
| Olefins %, pool basis | 30 | 10 | 15 | 5 | 10 | 6.6975 | 7.95 | 0 |
| Total olefins % in product | 24.65 | | | | | | | |
| Pool sulfur ppm in product | 29.78 | | | | | | | |

In Example 3, 53% of the middle stream can be blended in the gasoline stream without further processing. Furthermore, the olefin concentration increases to 24.65.

Examples 4–6 use the same flow scheme as in Examples 1–3 with the exception the feed to the fractionation column is subjected to a non-extractive mercaptan oxidation treatment and the low boiling stream is not subjected to post-fractionation treatment. The middle and heavy streams are treated as in Examples 1–3.

EXAMPLE 4

In Example 4, the pre-fractionation and post-fractionation treatment is operated to ensure that the total contribution of sulfur compounds to the gasoline pool is no more than 10 ppm by weight of the total gasoline pool. Because the FCC gasoline will contribute one-third of the gasoline in the pool, the three post-fractionation streams can contribute no more than 30 ppm by weight. Table 4 gives the distribution of sulfur contributions from each stream, the total sulfur contribution to the gasoline pool, the olefin contribution for each stream and the total olefin contribution.

In Example 4, the total olefin content of the three streams is 24.25% which is down from 30% in the feed. The total contribution of sulfur to the gasoline pool is under 10 ppm on a pool basis. The severity of the hydrotreating process in Example 4 must be greater than in Example 1 because there is a greater concentration of organic sulfur in the heavy stream and the hydrotreater has to reduce the organic sulfur concentration to a greater extent to compensate for the absence of sulfur reduction in the light stream.

EXAMPLE 5

In Example 5, the total pool sulfur contribution from the FCC unit is allowed to reach 30 ppm. To exploit the additional sulfur allowance, a portion of the middle stream is allowed to bypass the extraction process and further post-fractionation treatment before being blended with the gasoline pool. The bypass operation reduces the volume of middle stream to be treated, and hence reduces the size and cost of extraction process required.

Table V gives the distribution of sulfur contributions and olefin contribution from each stream and the total sulfur and olefin contribution to the gasoline pool.

TABLE IV

| S Distribution (ppm) | Feed | Light | Middle | Heavy | Mercaptan Oxidated Light | Extracted Middle | Hydro-treated Heavy |
|---|---|---|---|---|---|---|---|
| Mercaptans | 400 | 10 | 20 | 20 | 10 | 0.2 | 7 |
| Disulfides | 20 | 0 | 20 | 350 | 0 | 1 | 0 |
| Thiophenes | 400 | 10 | 100 | 290 | 10 | 1 | 0 |
| Benzothiophenes | 1500 | 0 | 0 | 1500 | 0 | 0 | 0 |
| Total | 2320 | 20 | 140 | 2160 | 20 | 2.2 | 7 |
| Pool contribution | 773.3 | 6.67 | 46.67 | 720 | 6.67 | 0.73 | 2.3 |
| Olefins %, pool basis | 30 | 10 | 15 | 5 | 10 | 14.25 | 0 |
| Total olefins % in product | 24.25 | | | | | | |
| Pool sulfur ppm in product | 9.73 | | | | | | |

TABLE V

| S Distribution (ppm) | Feed | Light | Middle | Heavy | Untreated Light | Extracted Middle | Blended Middle | Hydro-treated Heavy |
|---|---|---|---|---|---|---|---|---|
| Mercaptans | 400 | 10 | 20 | 20 | 10 | 0.117 | 8.3 | 10 |
| Disulfides | 20 | 0 | 20 | 350 | 0 | 0.585 | 8.3 | 0 |
| Thiophenes | 400 | 10 | 100 | 290 | 10 | 0.585 | 41.5 | 0 |
| Benzothiophenes | 1500 | 0 | 0 | 1500 | 0 | 0 | 0 | 0 |
| Total | 2320 | 20 | 140 | 2160 | 20 | 1.29 | 58.1 | 10 |
| Pool contribution | 773.33 | 6.67 | 46.67 | 720 | 6.67 | 0.429 | 19.37 | 3.33 |
| Olefins %, pool basis | 30 | 10 | 15 | 5 | 10 | 8.34 | 6.23 | 0 |
| Total olefins % in product | 24.56 | | | | | | | |
| Pool sulfur ppm in product | 29.80 | | | | | | | |

In Example 5, the total olefin content is increased to 24.56%, because less of the middle fraction is hydrotreated. The total contribution of sulfur to the gasoline pool is 29.80 ppm on a pool basis. In this example, 41.6% of the middle fraction is bypassed around the extraction process. Therefore the size of extraction plant is 58.4% of the capacity of Example 4. This illustrates that the use of pre-fractionation mercaptan oxidation treatment allows a greater amount of the middle stream to be blended to the gasoline pool directly without further treatment, and can substantially reduce the costs of treating this middle stream. The severity of the hydrotreating process is the same as in Examples 1–3 and did not need to be increased, as was the case in Example 4.

EXAMPLE 6

In Example 6, the feed of Example 3 with a lower sulfur concentration is subjected to the same treatment as Example 5. An maximum gasoline pool sulfur concentration of 30 ppm is applicable.

TABLE VI

| S Distribution (ppm) | Feed | Light | Middle | Heavy | Untreated Light | Extracted Middle | Blended Middle | Hydro-treated Heavy |
|---|---|---|---|---|---|---|---|---|
| Mercaptans | 160 | 5 | 5 | 10 | 5 | 0.007 | 4.3 | 10 |
| Disulfides | 10 | 0 | 10 | 140 | 0 | 0.07 | 8.6 | 0 |
| Thiophenes | 200 | 10 | 60 | 130 | 10 | 0.084 | 51.6 | 0 |
| Benzothiophenes | 700 | 0 | 0 | 700 | 0 | 0 | 0 | 0 |
| Total | 1070 | 15 | 75 | 980 | 15 | 0.161 | 64.5 | 10 |
| Pool contribution | 356.67 | 5 | 25 | 326.67 | 5 | 0.054 | 21.5 | 3.3 |
| Olefins %, pool basis | 30 | 10 | 15 | 5 | 10 | 1.995 | 12.9 | 0 |
| Total olefins % in product | 24.90 | | | | | | | |
| Pool sulfur ppm in product | 29.89 | | | | | | | |

In this case, as much as 86% of the mid-cut stream can be blended without additional processing for a 30 ppm gasoline pool target. The amount of mid-cut stream that required treating is small enough to be sent to a reformer unit or could even be blended with the heavy stream prior to hydrotreating, thereby obviating the need for treating it with sulfur extraction. Moreover, the total olefin concentration increases to 24.90%.

What is claimed is:

1. A process for removing sulfur from a hydrocarbon stream, said process comprising:

fractionating a feed stream into an overhead stream, a middle stream and a bottoms stream;

adding hydrogen to said bottoms stream;

hydrotreating said bottoms stream;

analyzing at least a portion of said overhead stream for sulfur content; and adding a portion of said middle stream to said overhead stream at a rate in response to the analysis of the sulfur content of the portion of said overhead stream.

2. The process of claim 1 further including treating a portion of said middle stream with a sulfur removal process.

3. The process of claim 2 wherein said sulfur removal process produces a thiophene-lean stream that is analyzed in mixture with the portion of said overhead stream for sulfur content.

4. The process of claim 1 further including adding a portion of said middle stream to said bottoms stream at a rate in response to the analysis of the sulfur content of the portion of said overhead stream.

5. The process of claim 4 further including treating a portion of said middle stream in a sulfur removal unit and adding a portion of said middle stream to said bottoms stream when said sulfur treatment unit is at or near full capacity.

6. The process of claim 1 further including treating a portion of one of said feed stream and said overhead stream by a mercaptan removal process.

7. A process for removing sulfur from a hydrocarbon stream, said process comprising:

fractionating a feed stream into an overhead stream, a middle stream and a bottoms stream;

adding hydrogen to said bottoms stream;

hydrotreating said bottoms stream;

treating a portion of one of said feed stream and said overhead stream by a mercaptan removal process;

analyzing at least a portion of said overhead stream for sulfur content downstream of said mercaptan removal process; and adding a portion of said middle stream to said overhead stream at a rate in response to the analysis of the sulfur content of the portion of said overhead stream.

8. The process of claim 7 further including treating a portion of said middle stream in a sulfur removal unit and adding a portion of said middle stream to said stream when said sulfur treatment unit is at or near full capacity.

* * * * *